US006872929B2

(12) United States Patent
Neculaes et al.

(10) Patent No.: US 6,872,929 B2
(45) **Date of Patent: *Mar. 29, 2005**

(54) LOW-NOISE, CROSSED-FIELD DEVICES SUCH AS A MICROWAVE MAGNETRON, MICROWAVE OVEN UTILIZING SAME AND METHOD OF CONVERTING A NOISY MAGNETRON TO A LOW-NOISE MAGNETRON

(75) Inventors: Vasile B. Neculaes, Ann Arbor, MI (US); Ronald M. Gilgenbach, Ann Arbor, MI (US); Yue-Ying Lau, Potomac, MD (US)

(73) Assignee: The Regents of the University of Michigan, Ann Arbor, MI (US)

( * ) Notice: Subject to any disclaimer, the term of this patent is extended or adjusted under 35 U.S.C. 154(b) by 95 days.

This patent is subject to a terminal disclaimer.

(21) Appl. No.: 10/417,655

(22) Filed: Apr. 17, 2003

(65) Prior Publication Data

US 2004/0206754 A1 Oct. 21, 2004

(51) Int. Cl.[7] ..... H05B 6/72
(52) U.S. Cl. ..... 219/761; 219/679
(58) Field of Search ..... 219/678, 679, 219/756, 761, 747; 315/39.65, 39.75, 39.51, 39.71, 39.3; 313/359.1, 361.1, 338, 356

(56) References Cited

U.S. PATENT DOCUMENTS

| | | | | |
|---|---|---|---|---|
| 3,932,820 A | | 1/1976 | Damon et al. | |
| 3,958,148 A | * | 5/1976 | Wilbur et al. | 315/39.65 |
| 4,310,786 A | | 1/1982 | Kumpfer et al. | |
| 4,465,953 A | | 8/1984 | Bekefi | |
| 4,668,924 A | | 5/1987 | Van De Sande | |
| 4,709,129 A | | 11/1987 | Osepchuk | |
| 4,855,645 A | * | 8/1989 | Kinuno et al. | 315/39.71 |
| 4,928,070 A | * | 5/1990 | MacMaster et al. | 315/39.3 |
| 5,412,281 A | * | 5/1995 | Farney et al. | 315/39.3 |
| 5,635,798 A | * | 6/1997 | Ogura et al. | 315/39.71 |
| 5,798,602 A | * | 8/1998 | Gopanchuk et al. | 313/359.1 |
| 6,437,510 B1 | | 8/2002 | Thomas et al. | |

FOREIGN PATENT DOCUMENTS

| | | |
|---|---|---|
| JP | 6-5211 | 1/1994 |
| JP | 9-129149 | 5/1997 |
| JP | 11-283517 | 10/1999 |

OTHER PUBLICATIONS

Osepchuk, John M., The Cooker Magnetron As A Standard In Crossed–Field Device Research, Proceedings of the First International Workshop on Crossed–Field Devices, Ann Arbor, MI, Aug. 15–16, 1995, University of Michigan, pp. 159–177.

(List continued on next page.)

*Primary Examiner*—Tu Hoang
(74) *Attorney, Agent, or Firm*—Brooks Kushman P.C.

(57) ABSTRACT

Low-noise, crossed-field devices such as a microwave magnetron, a microwave oven utilizing same, crossed-field amplifier and a method of converting a noisy magnetron to a low-noise magnetron utilize an azimuthally varying, axial magnetic field. The magnetic configuration reduces and eliminates microwave and radio frequency noise. This microwave noise is present near the carrier frequency and as sidebands, far separated from the carrier. The device utilizes azimuthally varying, axial, magnetic field perturbations. In one embodiment, at least one permanent magnet is placed against the azimuthally-symmetric, axial magnetic field magnetron magnets (four magnets work especially well). This additional permanent magnet(s) causes the axial magnetic field to vary azimuthally in the magnetron and completely eliminates the microwave noise and unwanted frequencies.

22 Claims, 3 Drawing Sheets

OTHER PUBLICATIONS

Jones, M.C., et al., Simulation of Rapid Startup In Microwave Magnetrons With Azimutally Varying Axial Magnetic Fields, Applied Physics Letters; vol. 84, No. 6, Feb. 9, 2004, pp. 1016–1018.

Neculaes, Vasile B., et al., Low–Noise Microwave Magnetrons By Azimuthally Varying Axial Magnetic Field, Applied Physics Letters, American Institute of Physics, New York, vol. 83, No. 10, pp. 1938–1940.

Sisodia, M.L., et al., Noise Reduction in Crossed Field Electron Guns By Cathode Tilt, Proc. IEEE, Jan. 1968, pp. 94–95.

Sidhu, G.S., et al., Noise Reduction in Kino Long Guns and Increasing Their Dynamic Range, Pro. IEEE, vol. 58, May 1979, pp. 825–826.

Nicholls, N.S., et al., Reduction of Noise In High Power Crossed–Field Amplifiers, Electronics Letters, vol. 9, No. 17, Aug. 23, 1973, pp. 398–399.

Wadhwa, R.P., Noise in Magnetron Injections Guns, Proc. IEEE, vol. 52, No. 79, Jan. 1964.

* cited by examiner

LOW-NOISE, CROSSED-FIELD DEVICES SUCH AS A MICROWAVE MAGNETRON, MICROWAVE OVEN UTILIZING SAME AND METHOD OF CONVERTING A NOISY MAGNETRON TO A LOW-NOISE MAGNETRON

STATEMENT REGARDING FEDERALLY SPONSORED RESEARCH OR DEVELOPMENT

This invention was made with Government support under Grant Nos. F49620-99-1-0297 and F49620-00-1-0088, awarded by the AFOSR. The Government has certain rights in the invention.

BACKGROUND OF THE INVENTION

1. Field of the Invention

This invention relates to low-noise, crossed-field devices such as microwave magnetrons, microwave ovens utilizing same, crossed-field amplifiers and methods of converting noisy magnetrons to low-noise magnetrons.

2. Background Art

The noise generation mechanisms of linear electron beam devices are well known. Generally, fluctuations of cathode electron emission excite space charge waves, which propagate along the electron beam. Calculations and computations of noise figures in linear devices agree with experiments. Methods of noise suppression in linear tubes are at a very advanced stage. On the other hand, noise generation mechanisms in cross-field devices are not presently understood and predictive computational calculations do not exist. Methods of noise suppression in crossed-field devices have not previously been practically realized.

Existing magnetrons and crossed-field amplifiers use an azimuthally-symmetric, axial magnetic field, shown in FIGS. 1*a* and 1*b* (exterior dashed line in FIG. 1*b*). In a standard microwave oven magnetron such as the magnetron, generally indicated at 70, of FIG. 7, permanent magnets 72 generate about 1 kGauss on the face, resulting in about 1.7 kGauss on-axis, at the midpoint between the two magnets 72. The magnetron 70 also typically includes a microwave output post 73, a magnetic metal yoke 74, cooling fins 75, a vacuum envelope 76 which contains cavities, a metal box containing chokes 77 and electrical cathode/filament connections 78. Such standard noisy magnetrons generate a copious amount of microwave noise near the carrier and more widely-spaced sidebands, as shown in one of the data plots of FIG. 5.

As described by J. M. Osepchuk in the 1995 article entitled "The Cooker Magnetron as a Standard in Crossed-Field Research," PROCEEDINGS OF THE FIRST INTERNATIONAL WORKSHOP ON CROSSED-FIELD DEVICES, Ann Arbor, Mich., Aug. 15–16, 1995, University of Michigan, "The existence of magnetron noise is assuming a very practical aspect. There are over 200 million microwave ovens in the world operating at 2.45 GHz. There also are plans for a wide variety of new 'wireles' services to operate with frequency allocations ranging from 1.5 GHz to 3.0 GHz and possibly even higher, especially at 5.8 GHz. There are some serious questions about the potential that some of these systems will encounter unacceptable interference from microwave ovens—i.e., the sideband noise. Thus the characteristics of microwave oven noise are being studied extensively and there are plans for interim and final (tighter) specifications to limit such noise through regulations originating in current activities of the CISPR community within the IEC (International Electrotechnical Commission). Because the noise is predominantly at low anode currents most of the time, microwave oven noise shows up as sub-millisecond pulses of noise. Some experts believe modern digital and spread-spectrum communication techniques can live with this. On the other hand, if discrete spurious signals show up especially at close to peak current, the RFI might not be tolerable. The magnitude of the peak noise or spurious in the worst cases is of the order of 100 dB above a pW as measured in a 1 MHz bandwidth or even higher (or similar numbers in units of $\mu$V/m as measured at 3 meters from the oven). At present some authorities are investigating peak limits near such levels along with limits 30 to 40 dB lower when using narrow video bandwidths (e.g. 100 Hz) to yield 'average' measures of the noise."

As further described in the above-noted article, "Cooker magnetron noise, therefore, will attract regulatory pressure in the future at the same time that others, i.e., the DOE in the U.S., are pressuring for higher oven efficiency which is, in principle, associated with higher noise. At the same time there are other magnetron-driven ISM devices that may amplify the concern about noise, e.g., the microwave 'sulfur' lamps, that are very efficient light sources that some day may operate for many hours per night illuminating large areas in buildings and parking lots, etc. One can presume that users of magnetrons may be forced to find ways of reducing such noise. Otherwise, competing devices might for the first time in history pose a threat to the magnetron as the power source of choice for ovens and other power applications. In the past year there was the preliminary report of an efficient (67%), low voltage (600 Volts) multi-beam klystron suitable for microwave oven use. Its developers estimate that in three years problems of cost, size and weight might be resolved. The klystron poses no noise problems and has other advantages. One can expect controversial discussions of competing power sources at meetings such as those of IMPI (the International Microwave Power Institute)."

Since the above-noted article was written, several communications systems have developed in the unlicensed, 2.4 GHz radio spectrum:

1) cordless telephones operating at 2.4 GHz;
2) Bluetooth, a wireless communication system used for computers, which operates with a spread spectrum, frequency-hopping, full-duplex signal; and
3) IEEE 802.11 b and 802.11 g, a Complementary Code Keying-Orthogonal Frequency Division Multiplexing system used for computer Local Area Networks (LANs), operating in the frequency range from 2.4 GHz to 2.4835 GHz.

Since these communication systems occupy the same region of the spectrum utilized by microwave ovens, there exists significant potential for interference from noisy magnetrons.

U.S. Pat. No. 4,465,953 issued to Bekefi uses a magnetic configuration which modulates the radial magnetic field by an azimuthally, spatially-periodic array of magnets in a magnetron to generate free electron laser radiation.

U.S. Pat. No. 3,932,820 issued to Damon et al. discloses how the noise in a crossed-field amplifier output is reduced by providing a non-uniform magnetic field across the surface of a cathode. A curved magnetic field may be provided across the cathode or by providing a concave shaped cathode. Additionally, the cathode may be tilted with respect to the crossed magnetic field.

U.S. Pat. No. 4,709,129 issued to Osepchuk discloses a typical microwave power source for a microwave oven in which a microwave magnetron is supplied simultaneously with filament heater power and with anode voltage through an inductive reactance power supply.

U.S. Pat. No. 6,437,510 issued to Thomas et al. discloses a crossed-field amplifier or magnetron which has a cathode body portion and an anode which cooperates with a crossed magnetic field to maintain emitted electrons on cycloidal paths and amplify an input signal or develop a microwave or millimeter wave output signal in an interaction space.

U.S. Pat. No. 4,310,786 issued to Kumpfer discloses a magnetron electron discharge device preferably for use in microwave heating or cooking apparatus which has a cylindrical resonant anode structure surrounding a concentric electron emitting filament.

SUMMARY OF THE INVENTION

An object of the present invention is to provide low-noise, crossed-field devices such as a microwave magnetron, a microwave oven utilizing same, crossed-field amplifiers, and a method for converting a noisy magnetron to a low-noise magnetron by the use of an azimuthally varying, axial magnetic field.

In carrying out the above object and other objects of the present invention, a low-noise, crossed-field device is provided. The device includes an electrical circuit for generating a radial electrical field, and a magnetic circuit for generating an axial magnetic field substantially perpendicular to the radial electric field. The axial magnetic field is azimuthally varying to substantially eliminate noise in the device.

The device may be a microwave magnetron including a cathode for emitting electrons and an anode having a plurality of resonant cavities. The cathode and anode may define an interaction space therebetween wherein interactions between electrons emitted from the cathode and the electric and magnetic fields produce a series of space charge spokes that travel around the space in an azimuthal direction.

The microwave magnetron may be a plasma processing magnetron, an oven magnetron, a lighting magnetron, or an industrial heating magnetron.

The device may be a crossed-field amplifier including an input for receiving an input signal to be amplified within the device and an output for carrying an amplified signal from the device.

The amplifier may be a radar amplifier.

The magnetic circuit may include at least one perturbing magnetic field source for causing azimuthally varying perturbations in the axial magnetic field.

The at least one perturbing magnetic field source may include at least one permanent perturbing magnet, at least one shaped magnetic pole piece, or at least one shaped coil or multiple coils.

The magnetic circuit may includes a pair of spaced magnets and at least one perturbing magnet coupled to at least one of the spaced magnets for causing azimuthally varying perturbations in the axial magnetic field.

The magnetic circuit may further include a plurality of perturbing magnets.

The device may be a microwave magnetron having start-up and peak power phases, and the noise may be substantially eliminated independent of magnetron current.

The device may be a linear crossed-field amplifier including a cavity region, and the magnetic field may vary in a direction of electron drift in the cavity region.

The device may be a microwave magnetron including one of a plurality of mode control devices such as strapping and rising sun geometries, or a coaxial cavity magnetron.

A typical magnitude of azimuthal variations of the axial magnetic field may be approximately 50%.

Further in carrying out the above object and other objects of the present invention, a microwave oven is provided. The microwave oven includes a compartment, and a low-noise, oven magnetron for generating microwaves in the compartment. The magnetron includes an electrical circuit for generating a radial electrical field. The circuit includes a cathode for emitting electrons and an anode having a plurality of resonant cavities. The cathode and the anode define an interaction space therebetween. The magnetron further includes a magnetic circuit for generating an axial magnetic field substantially perpendicular to the radial electrical field in the interaction space wherein interactions between electrons emitted from the cathode and the electric and magnetic fields produce a series of space-charge spokes that travel around the space in an azimuthal direction. The axial magnetic field is azimuthally varying in the interaction space to substantially eliminate noise in the device.

Still further in carrying out the above object and other objects of the present invention, a method of converting a noisy magnetron to a low-noise magnetron is provided. The noisy magnetron includes an electrical circuit for generating a radial electric field and a magnetic circuit for generating an axial magnetic field substantially perpendicular to the radial electric field. The method includes azimuthally varying the axial magnetic field to substantially eliminate noise in the noisy magnetron.

The magnetic circuit may include a pair of spaced magnets, and the step of azimuthally varying may include the step of coupling at least one perturbing magnet to at least one of the spaced magnets for causing azimuthally varying perturbances in the axial magnetic field.

A typical magnitude of azimuthal variations of the axial magnetic field may be approximately 50%.

The above object and other objects, features, and advantages of the present invention are readily apparent from the following detailed description of the best mode for carrying out the invention when taken in connection with the accompanying drawings.

BRIEF DESCRIPTION OF THE DRAWINGS

FIG. 8 is a schematic block diagram of a crossed-field amplifier (i.e. CFA) in accordance with the present invention.

DETAILED DESCRIPTION OF THE PREFERRED EMBODIMENTS

Figure 2A:
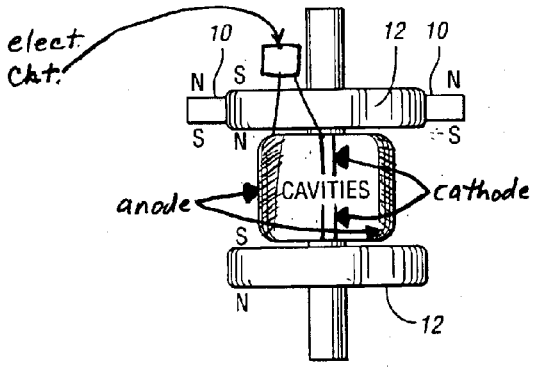
FIG. 2*a* is a side schematic view of an oven magnetron including magnets for generating an azimuthally varying axial magnetic field in its magnetic configuration.
Figure 2B:
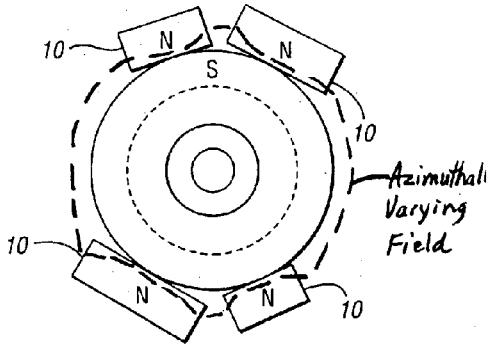
FIG. 2*b* is a top view of the magnetron of FIG. 2*a;*

In general, low-noise, crossed-field devices such as a microwave magnetron and microwave oven utilizing same are disclosed. In a first embodiment of the invention, at least one permanent magnet is added to the existing magnetron magnets to cause the axial magnetic field to vary azimuthally (exterior dashed line in FIG. 2*b*). This embodiment of the invention is depicted in FIGS. 2*a* and 2*b*, in which four permanent magnets 10 have been added to one of the prior art magnets 12 (either upper or lower). Each magnet 10 has a strength of 3.0 to 4 kGauss on their face. The added permanent magnets 10 are located with their magnetic poles opposing (or adding to) the axial direction of the field of the standard, azimuthally-symmetric magnetron magnets 12. It is not crucial that the perturbing magnets 10 be exactly the same size or magnetic field, nor that they be symmetrically located around the periphery of one of the standard magnets 12.

FIG. 2*a* also shows a cathode, an anode and an electrical circuit for generating a radial electric field.

The perturbing magnets 10 perturb the axial magnetic field of the magnetron or crossed-field amplifier (i.e. FIG. 8).

Figure 1A:
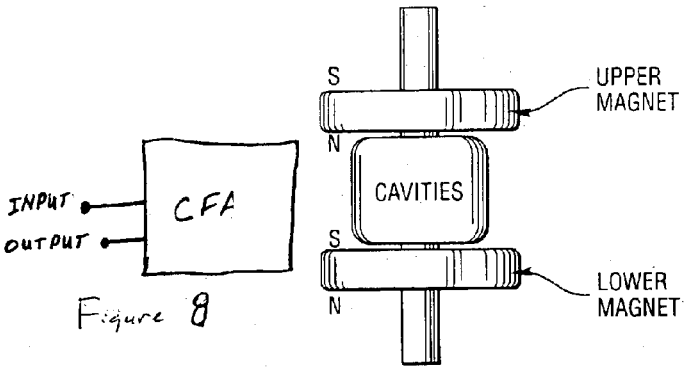
Fig. 1a (PRIOR ART)
FIG. 1*a* is a side schematic view of a prior art oven magnetron including its magnetic configuration.
Figure 1B:
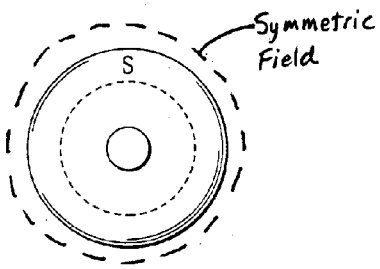
Fig. 1b (PRIOR ART)
FIG. 1*b* is a top view of the magnetron of FIG. 1*a;*
Figure 5:
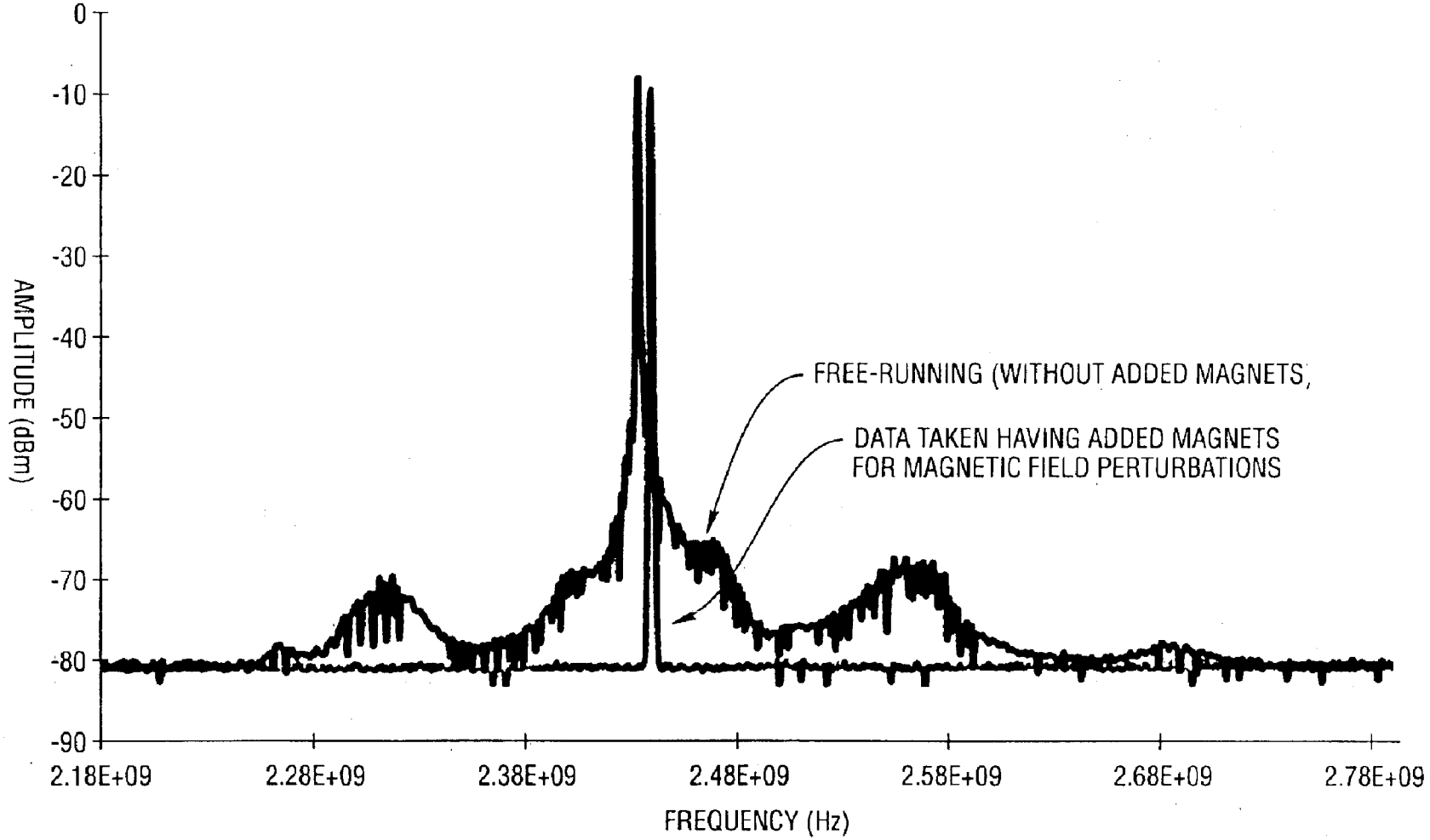
FIG. 5 is a graph of signal amplitude versus frequency for a prior art oven magnetron and an oven magnetron of the present invention.

FIG. 5 shows the experimental data of microwave spectra, in which a noisy, standard magnetron without the invention (i.e., FIGS. 1*a* and 1*b*) has been compared to a magnetron with the magnetic configuration of a first embodiment of the present invention (i.e., FIGS. 2*a*–2*b*). It can be seen that the first embodiment of the invention completely eliminates the noise and sidebands in the oven magnetron of FIGS. 2*a*–2*b*.

Figure 3:
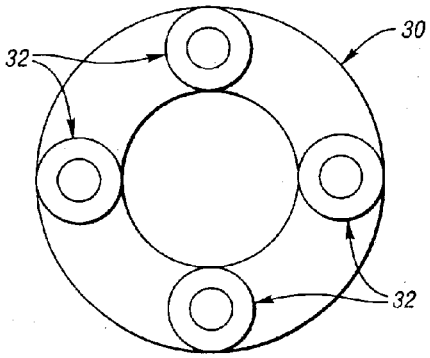
FIG. 3 is a top schematic view of a magnetron including coils for generating an azimuthally varying axial magnetic field constructed in accordance with a second embodiment of the present invention.
Figure 4A:
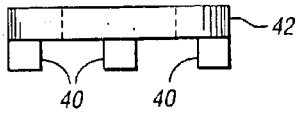
FIG. 4*a* is a side schematic view of an upper (or lower) magnet of a magnetron including magnetic pole pieces constructed in accordance with a third embodiment of the present invention.
Figure 4B:
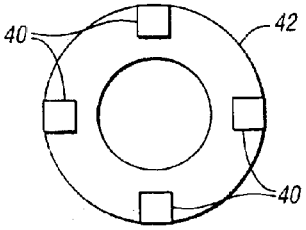
FIG. 4*b* is a bottom view of the magnetron magnet of FIG. 4*a;*

FIGS. 3 and 4*a*–4*b* show alternative apparatus of generating azimuthally varying axial magnetic field for a magnetron (or crossed-field amplifier).

In general, in order to generate an azimuthally varying axial magnetic field, a number of different embodiments are possible, including, but not limited to:

1) permanent magnets;

2) shaped magnetic pole pieces; or/and 3) shaped coils or multiple coils.

FIG. 3 is a top view of a second embodiment of the present invention wherein a large magnetron coil or magnet 30 creates a main axial magnetic field. Small coils 32 generate the azimuthally varying axial magnetic field.

FIGS. 4*a* and 4*b* are side and bottom views, respectively, of a third embodiment of the present invention wherein magnetic pole pieces 40 generate an azimuthally varying axial magnetic field. The pole pieces 40 are coupled to an upper (or lower) magnetron magnet 42.

Figure 6:
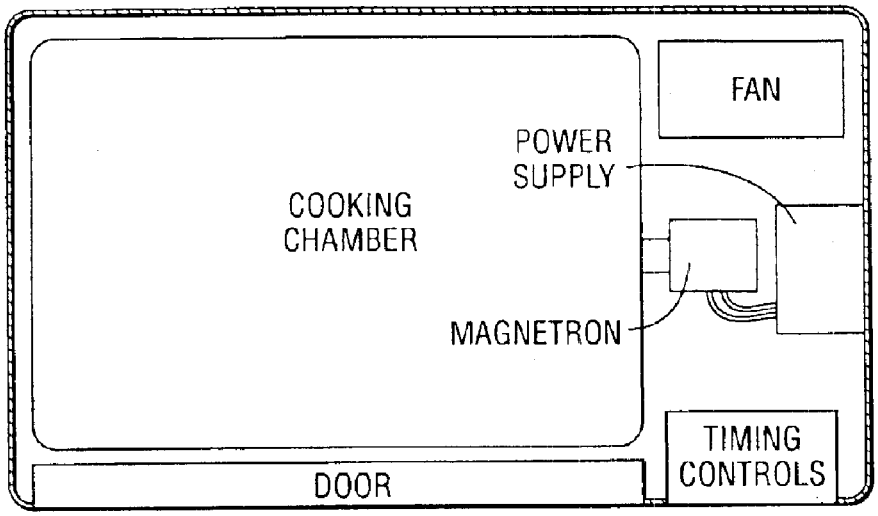
FIG. 6 is a sectional, top schematic view of a microwave oven including a magnetron of the present invention.
Figure 7:
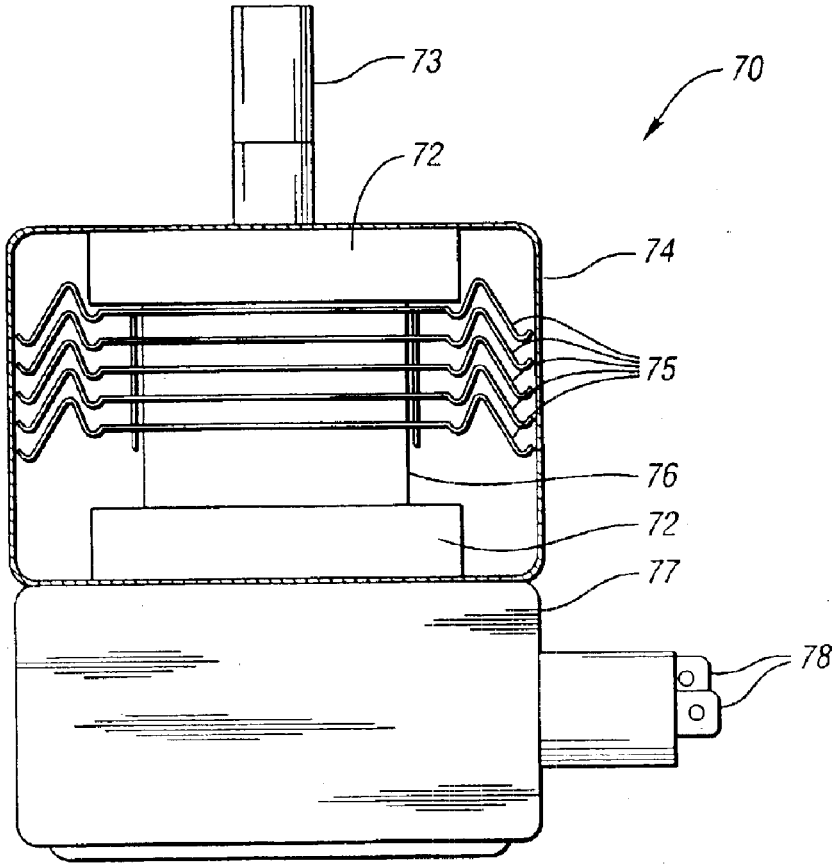
Fig. 7 (PRIOR ART)
FIG. 7 is a side schematic view of a conventional magnetron which may be noisy and which may be used in a conventional microwave oven.

FIG. 6 schematically shows a microwave oven including a cooking chamber or compartment of the present invention. The oven includes an oven magnetron of the present invention coupled to the chamber for generating microwaves therein. The oven also includes a power supply for the magnetron as well as timing controls. The oven further includes a door and a fan as is well known in the art.

The low-noise, crossed-field devices have application to reducing interference with telephone and computer communications by microwave magnetrons in microwave ovens.

Magnetrons are also used for lighting and industrial heating and the noise-free magnetrons of the present invention are applicable in these areas.

The efficiency of magnetrons would also be improved for applications which require a precise microwave frequency, such as plasma processing.

Another important application of the invention is the reduction of noise in crossed-field amplifiers utilized for the Department of Defense. This could lead to higher signal-to-noise ratios and better resolution for radars.

The invention reduces the noise in magnetrons, both during the critical startup phase and in the peak power phase. The reduction of noise is independent of magnetron current. Microwave noise is reduced in both new magnetrons and older, noisy magnetrons.

This invention extends to a linear crossed-field amplifier in which the transverse magnetic field varies in the direction of the electron drift in the cavity region.

This invention also applies to magnetrons that employ mode control devices such as strapping and rising sun geometries, as well as coaxial cavity magnetrons.

The typical magnitude of the azimuthal variations of the axial magnetic field are in the range of 50%.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A low-noise, crossed-field device comprising:

an electrical circuit for generating a radial electrical field; and a magnetic circuit for generating an axial magnetic field substantially perpendicular to the radial electric field wherein the axial magnetic field is azimuthally varying to substantially eliminate microwave noise.

2. The device as claimed in claim 1 wherein the device is a microwave magnetron which generates microwaves and including a cathode for emitting electrons and an anode having a plurality of resonant cavities and wherein the cathode and anode define an interaction space therebetween wherein interactions between electrons emitted from the cathode and the electric and magnetic fields produce a series of space charge spokes that travel around the space in an azimuthal direction.

3. The magnetron as claimed in claim 2 wherein the microwave magnetron is a plasma processing magnetron.

4. The magnetron as claimed in claim 2 wherein the microwave magnetron is an oven magnetron.

5. The magnetron as claimed in claim 2 wherein the microwave magnetron is a lighting magnetron.

6. The magnetron as claimed in claim 2 wherein the microwave magnetron is an industrial heating magnetron.

7. The device as claimed in claim 1 wherein the device is a crossed-field amplifier including an input for receiving an input signal to be amplified within the device and an output for carrying an amplified signal from the device.

8. The device as claimed in claim 7 wherein the amplifier is a radar amplifier.

9. The device as claimed in claim 1 wherein the magnetic circuit includes at least one perturbing magnetic field source for causing azimuthally varying perturbations in the axial magnetic field.

10. The device as claimed in claim 9 wherein the at least one perturbing magnetic field source includes at least one permanent perturbing magnet.

11. The device as claimed in claim 9 wherein the at least one perturbing magnetic field source includes at least one shaped magnetic pole piece.

12. The device as claimed in claim 9 wherein the at least one perturbing magnetic field source includes at least one shaped coil or multiple coils.

13. The device as claimed in claim 1 wherein the magnetic circuit includes a pair of spaced magnets and at least one perturbing magnet coupled to at least one of the spaced magnets for causing azimuthally varying perturbations in the axial magnetic field.

14. The device as claimed in claim 11 wherein the magnetic circuit includes a plurality of perturbing magnets.

15. The device as claimed in claim 1 wherein the device is a microwave magnetron which generates microwaves and having startup and peak power phases and wherein the noise is substantially eliminated independent of magnetron current.

16. The device as claimed in claim 1 wherein the device is a linear crossed-field amplifier including a cavity region and wherein the magnetic field varies in a direction of electron drift in the cavity region.

17. The device as claimed in claim 1 wherein the device is a microwave magnetron which generates microwaves and comprises one of a plurality of mode control devices which includes strapping and rising sun geometries, or a coaxial cavity magnetron.

18. The device as claimed in claim 1 wherein a typical magnitude of azimuthal variations of the axial magnetic field is approximately 50%.

19. A microwave oven comprising:

a compartment; and a low-noise, oven magnetron for generating microwaves in the compartment, the magnetron including:

an electrical circuit for generating a radial electrical field, the circuit including a cathode for emitting electrons and an anode having a plurality of resonant cavities wherein the cathode and the anode define an interaction space therebetween; and a magnetic circuit for generating an axial magnetic field substantially perpendicular to the radial electrical field in the interaction space wherein interactions between electrons emitted from the cathode and the electric and magnetic fields produce a series of space-charge spokes that travel around the space in an azimuthal direction and wherein the axial magnetic field is azimuthally varying in the interaction space to substantially eliminate microwave noise.

20. A method of converting a noisy magnetron which generates microwaves to a low-noise magnetron, the noisy magnetron having an electrical circuit for generating a radial electric field and a magnetic circuit for generating an axial magnetic field substantially perpendicular to the radial electric field, the method comprising:

azimuthally varying the axial magnetic field to substantially eliminate microwave noise in the noisy magnetron.

21. The method of claim 20 wherein the magnetic circuit includes a pair of spaced magnets and wherein the step of azimuthally varying includes the step of coupling at least one perturbing magnet to at least one of the spaced magnets for causing azimuthally varying perturbances in the axial magnetic field.

22. The method of claim 20 wherein a typical magnitude of azimuthal variations of the axial magnetic field is approximately 50%.

* * * * *